US008834195B2

(12) United States Patent
Arcykiewicz et al.

(10) Patent No.: US 8,834,195 B2
(45) Date of Patent: Sep. 16, 2014

(54) CABLE CONNECTOR SYSTEM

(71) Applicant: Amphenol Corporation, Wallingford, CT (US)

(72) Inventors: Robert Arcykiewicz, Bartlett, IL (US); Dean Wayne Nagy, Spring Grove, IL (US)

(73) Assignee: Amphenol Corporation, Wallingford, CT (US)

( * ) Notice: Subject to any disclaimer, the term of this patent is extended or adjusted under 35 U.S.C. 154(b) by 126 days.

(21) Appl. No.: 13/693,625

(22) Filed: Dec. 4, 2012

(65) Prior Publication Data

US 2014/0154909 A1 Jun. 5, 2014

(51) Int. Cl.
*H01R 4/50* (2006.01)
*H01R 13/514* (2006.01)

(52) U.S. Cl.
CPC ..... *H01R 13/514* (2013.01)
USPC ..... 439/346; 439/102

(58) Field of Classification Search
CPC .. H01R 13/20; H01R 13/2421; H01R 13/514; H01R 13/652; H01R 23/7073; H01R 24/58; H01R 2103/00
USPC ..... 439/102, 106, 346, 660, 668, 669, 675, 439/700, 701
See application file for complete search history.

(56) References Cited

U.S. PATENT DOCUMENTS

| | | | | |
|---|---|---|---|---|
| 277,641 | A | 5/1883 | Weston | |
| 2,753,531 | A | 7/1956 | Butler | |
| 3,042,896 | A | 7/1962 | Doktor | |
| 3,891,289 | A * | 6/1975 | Hanke | 439/106 |
| 4,061,409 | A * | 12/1977 | Bealmear | 439/346 |
| 4,302,066 | A | 11/1981 | Newman et al. | |
| 4,542,946 | A * | 9/1985 | Snow | 439/108 |
| 5,003,439 | A | 3/1991 | Yang | |
| 5,316,493 | A * | 5/1994 | Sowers | 439/346 |
| 5,527,190 | A * | 6/1996 | Weingartner | 439/669 |
| 5,632,643 | A * | 5/1997 | Shepherd et al. | 439/368 |
| 5,941,724 | A * | 8/1999 | Reed | 439/346 |
| 6,315,593 | B1 * | 11/2001 | Bentley et al. | 439/346 |
| 6,317,497 | B1 | 11/2001 | Ou | |
| 6,575,759 | B1 | 6/2003 | Ollivier | |
| 6,619,975 | B2 * | 9/2003 | Bentley et al. | 439/346 |

(Continued)

FOREIGN PATENT DOCUMENTS

| | | |
|---|---|---|
| DE | 4014384 | 10/1991 |
| FR | 2651381 | 3/1991 |
| JP | 2004-179131 | 6/2004 |
| JP | 2010-166696 | 7/2010 |

*Primary Examiner* — Thanh Tam Le
(74) *Attorney, Agent, or Firm* — Blank Rome LLP

(57) ABSTRACT

A cable connector system that comprises a first contact assembly that includes a housing and a first contact received in the housing, where the first contact has a cable termination portion and an interface portion that includes a first contact surface and a cap that has a first locking surface. A second contact assembly mates with the first contact assembly and includes a housing and a second contact that has a second contact surface configured to engage the first contact surface and the second contact being rotatable with respect to the first contact. A locking member that includes a second locking surface is configured to engage the first locking surface, wherein when the second locking surface engages the first locking surface, the first contact assembly is prevented from moving axially with respect to the second contact assembly while the first contact remains rotatable with the second contact.

23 Claims, 6 Drawing Sheets

(56) References Cited

U.S. PATENT DOCUMENTS

| | | | | |
|---|---|---|---|---|
| 6,923,686 | B1 | 8/2005 | Cheng | |
| 6,984,145 | B1 * | 1/2006 | Lim | 439/462 |
| 7,780,479 | B2 * | 8/2010 | Khemakhem et al. | 439/668 |
| 7,811,136 | B1 | 10/2010 | Hsieh et al. | |
| 7,854,636 | B2 | 12/2010 | Gilliam | |
| 8,011,977 | B2 * | 9/2011 | Tsuruta et al. | 439/752 |
| 8,142,231 | B2 * | 3/2012 | Tung et al. | 439/660 |
| 2006/0121761 | A1 | 6/2006 | Chaabane et al. | |
| 2009/0181573 | A1 | 7/2009 | Wang et al. | |
| 2012/0264322 | A1 | 10/2012 | Grek et al. | |

* cited by examiner

CABLE CONNECTOR SYSTEM

FIELD OF THE INVENTION

The present invention relates to cable connector system. More specifically, the cable connector system is insulated and includes lockable contact assemblies for safe and efficient power distribution.

BACKGROUND OF THE INVENTION

Conventional power cables are typically plugged into a panel for power distribution systems. For example, portable power generation systems include large shipping container-like units that contain power generation equipment and supply power to moveable oil drilling rigs. Problems often occur in such distribution systems with installation errors due to mis-tightening of connections. Often those connections become loose. Also, electrically charged surfaces of such systems are often exposed. Additionally, the cables of those conventional systems are rigidly connected to the panels and thus have no freedom of movement.

Therefore, a need exists for safe and efficient power distribution that reduces installation errors and costs.

SUMMARY OF THE INVENTION

Accordingly, the present invention provides a cable connector system that comprises a first contact assembly that includes a housing and a first contact that is received in the housing. The first contact has a cable termination portion that is configured to terminate a cable at an end thereof and an interface portion that includes a first contact surface and a cap at an end thereof. The cap has a first locking surface. A second contact assembly mates with the first contact assembly and includes a housing and a second contact received in the housing. The second contact has a second contact surface that is configured to engage the first contact surface of the first contact assembly and the second contact is rotatable with respect to the first contact of the first contact assembly. A locking member that includes a second locking surface is configured to engage the first locking surface of the cap, wherein when the second locking surface engages the first locking surface, the first contact assembly is prevented from moving axially with respect to the second contact assembly while the first contact remains rotatable with respect to the second contact.

The present invention may also provide a cable connector system that comprises a first contact assembly that includes a housing, a first conductive contact that is received in the housing, and a receiving area that is defined between the housing and the first conductive contact. The housing is insulative. The first conductive contact has a cable termination portion configured to terminate a cable at an end thereof and an interface portion that includes a first contact surface and a cap at an end thereof. The cap is insulative. A second contact assembly mates with the first contact assembly. The second contact assembly includes an outer housing and a second conductive contact that is received in the outer housing. The outer housing is insulative. The second conductive contact has a second contact surface that is configured to engage the first contact surface of the first contact assembly that defines an electrical path therebetween. An insulative plug is configured to be received in the second contact assembly when the second contact assembly is not mated with the first contact assembly, wherein when the first and second contact assemblies are mated, the housing of the first contact assembly covers all exposed surfaces of the second conductive contact and the outer housing of the second contact assembly covers all exposed surfaces of the first conductive contact, and wherein when the first and second contact assemblies are unmated, the cap and the housing of the first contact assembly covers all exposed surfaces of the first conductive contact and the outer housing of the second contact assembly and the insulative plug cover all exposed surfaces of the second conductive contact.

The present invention may further provide a cable connector system that comprises a plurality of first contact assemblies. Each of the first contact assemblies includes a first contact that has a cable termination portion configured to terminate a cable at an end thereof and an interface portion that includes a first contact surface and a cap at an end thereof. The cap has a first locking surface. A plurality of second contact assemblies are mateable with the first contact assemblies. Each of the second contact assemblies includes a second contact that has a second contact surface that is configured to engage the first contact surfaces, respectively. Each of the second contacts is rotatable with respect to each of the first contacts. A housing block supports the second contact assemblies. A locking member that includes a second locking surface is configured to engage the first locking surfaces of the first contact assemblies, wherein when the second locking surface engages each of the first locking surfaces, each of the first contact assemblies is prevented from moving axially with respect to each of the second contact assemblies while each of the first contacts remain rotatable with each of the second contacts.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Referring to FIGS. 1-11, a cable connector system 100 in accordance with an exemplary embodiment of the present invention generally comprises one or more pin contact assemblies 110 that are adapted to mate with one or more socket contact assemblies 130. The cable connector system 100 may be used, for example, to provide safe and efficient power distribution, such as in power generation systems and the like. Both the pin contact assemblies 110 and the socket contact assemblies 130 are preferably electrically insulated such that no conductive surfaces are exposed, thereby preventing contact, accidental or otherwise, with electrically powered surfaces or contacts. The cable connector system 100 preferably also includes one or more locking members 160 to prevent loosening or separation of the mated pin contact and socket contact assemblies 110 and 130 to ensure proper electrical contact therebetween. The invention can be used anywhere a power connection is required, a quick connect and disconnect would be beneficial; positive locking is needed; a degree of freedom that allows the cable to position itself rotationally, minimizing internal cable torsion is needed; and efficient carrying of increased electrical loads is needed. The system 100 of the present invention reduces installation errors due to mis-tightening of the connection. That in turn reduces installation costs, particularly when the equipment moves around from location to location, country, state, or worksite.

Figure 1:
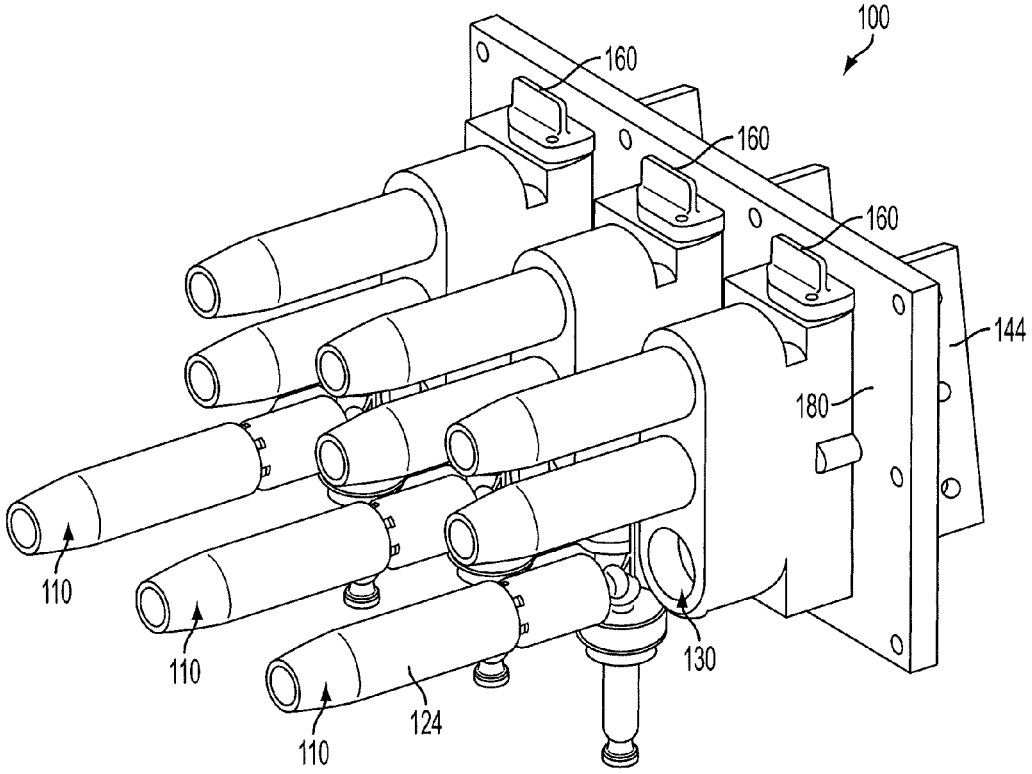
FIG. 1 is a perspective view of a cable connector system according to an exemplary embodiment of the invention, showing a plurality of socket contact assemblies that mate with a plurality of plug contact assemblies.
Figure 2:
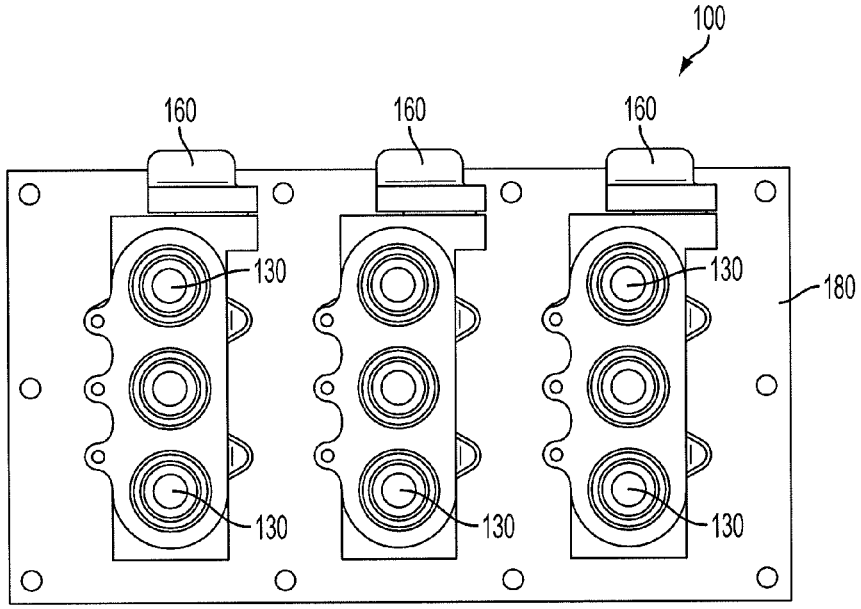
FIG. 2 is a front plan view of the plurality of socket contact assemblies illustrated in FIG. 1.

As seen in FIGS. 1 and 2, the socket contact assemblies 130 are preferably mounted to an insulative panel 180 that may be in turn be mounted to an electrical panel (not shown) for power distribution. The pin contact assemblies 110 each terminate individual power cables (not shown). The pin and socket contact assemblies 110 and 130 are designed to mate such that the system is electrically insulated to avoid contact with conductive surfaces. The socket contact assemblies 130 are preferably grouped together, such as in groups of three, as seen in FIG. 1; however the system may include a single socket contact assembly 130 that mates with a single pin contact assembly 110.

Figure 3:
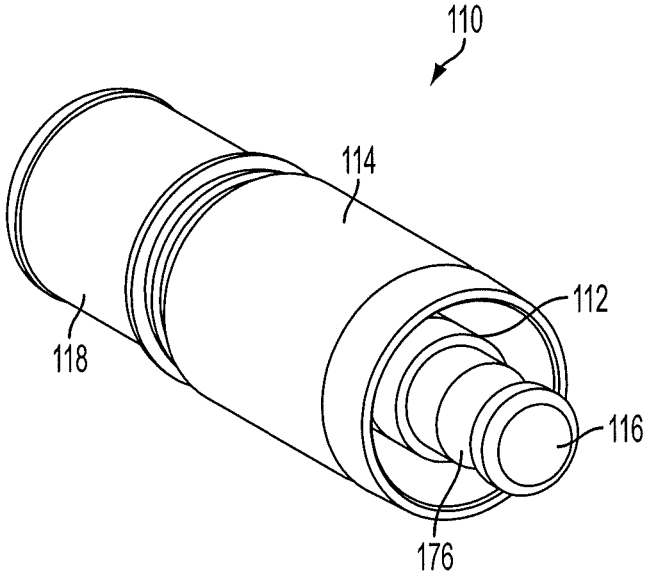
FIG. 3 is a perspective view of one of the plurality of plug contact assemblies illustrated in FIG. 1.
Figure 4:
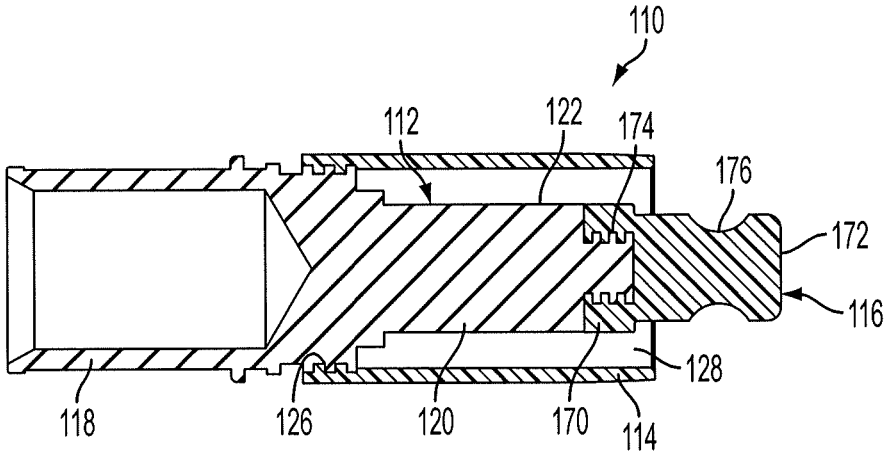
FIG. 4 is a cross-sectional view of the plug contact assembly illustrated in FIG. 3.

FIGS. 3 and 4 illustrate an exemplary pin contact assembly 110 in accordance with the present invention. The pin contact assembly 110 generally includes a contact 112, a main housing 114, and a cap 116. The contact 112 may have a cable termination portion 118 and an interface portion 120. The cable termination portion 118 is designed to terminate a cable (not shown) in any known manner. The interface portion 120 preferably has the shape of a pin that has an outer contact surface 122 configured to engage a contact of a mating socket contact assembly 130, thereby creating an electrical path therebetween.

The main housing 114 generally supports and covers the interface portion 120 of the contact 112. A secondary cover 124 (FIG. 1) may be used to cover the cable termination portion 118 of the contact 112. The main housing 114 may be attached to the contact 112 by a threaded engagement 126 or by any other known attachment. A receiving area 128 is defined between the main housing 114 and the contact 112 that is adapted to receive a portion of the socket contact assembly 130.

The cap 116 is disposed at the end of the interface portion 120, as best seen in FIG. 4. The cap 116 includes opposing ends 170 and 172 where one end 170 is coupled to the interface portion 120 at the end thereof, such as by a threaded engagement 174 or other known engagement. The other end 172 of the cap 116 is sized to be received in the mating socket contact assembly 130 and includes a locking surface 176 that may be in the form of an annular groove.

Both the main housing 114 and the cap 116 are formed of a insulative material. The insulative main housing 114 covers the outer contact surface 122 of the conductive contact 112 and the insulative cap 116 is disposed on and covers the end of the contact 112 such that any exposed surfaces of the contact 112 are covered by an insulative material or member.

Figure 6:
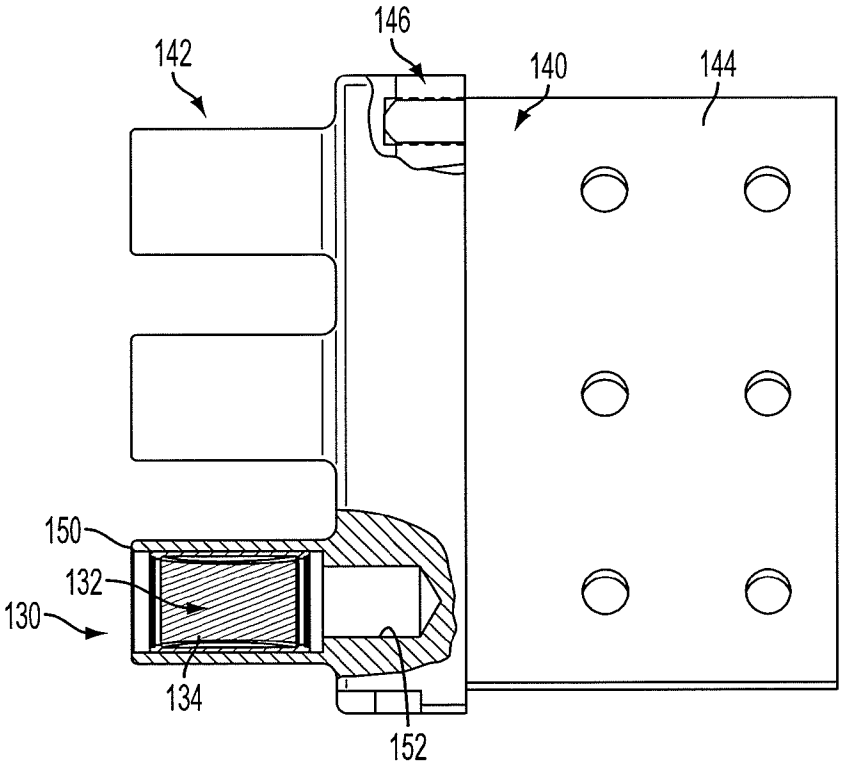
FIG. 6 is a side elevational view of the block housing illustrated in FIG. 5, showing a partial cross-sectional view of a socket.
Figure 5:
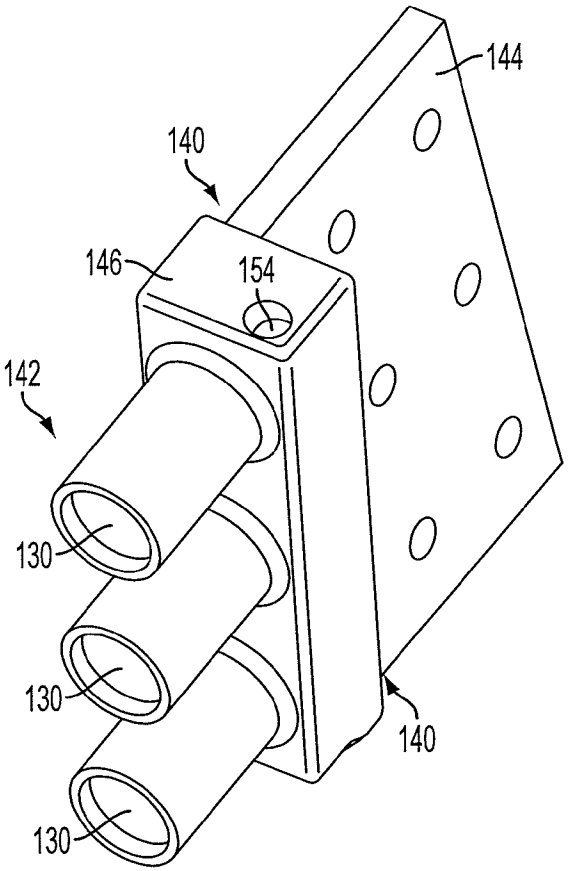
FIG. 5 is a perspective view of a block housing of one of the plurality of socket contact assemblies illustrated in FIG. 1.
Figure 8:
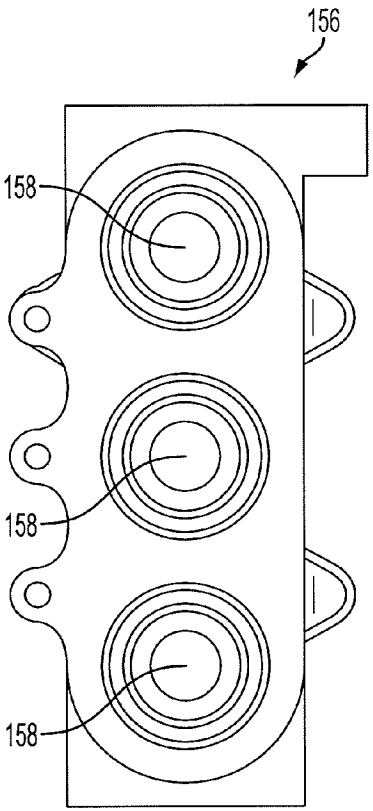
FIG. 8 is a front elevational view of the outer housing illustrated in FIG. 7.
Figure 7:
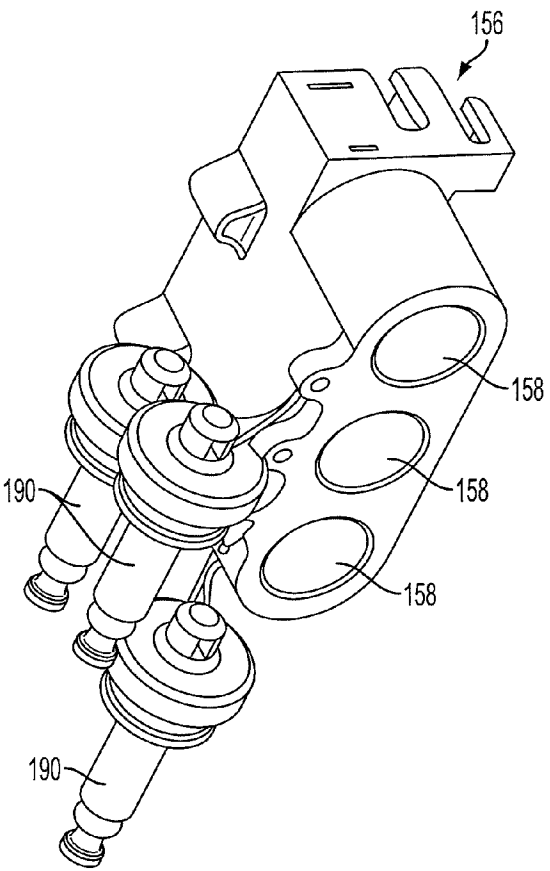
FIG. 7 is a perspective view of an outer housing of one of the plurality of socket contact assemblies illustrated in FIG. 1.

FIGS. 5 and 6 illustrate one or more socket contact assemblies 130 being supported by a housing block 140. Each socket contact assembly 130 includes a contact 132 that is preferably a socket. As best seen in FIG. 6, the socket 132 may be a radially resilient barrel with an internal hollow cylindrical sleeve or contact surface 134 adapted to receive and engage the contact 112 of the mating pin contact assembly 110. The socket 132 is designed to allow for increased electrical loads. The hollow sleeve 134 may be formed by adding contactor strips to the inside of the barrel, as described in commonly owned U.S. Pat. No. 4,734,063, herein incorporated by reference. The contactor strips provide a continuous electrical connection with the inserted pin contact 112, while permitting the pin contact 112 to rotate with respect to the socket contact 132.

The housing block 140 is preferably conductive and generally has three sections including a socket supporting section 142, a panel section 144, and a mid-section 146 therebetween. The socket supporting section 142 has an inner bore 148 that receives the socket contact 132 and an open end 150 that receives the mating pin contact 112. The panel section 144 is a flat member extending from the mid-section 146 that extends through the insulative panel 180, as seen in FIG. 1. The mid-section 146 has a secondary bore 152 that is continuous with the inner bore 148 of the supporting section 142 and is sized to receive the cap 116 of the mating pin contact assembly 110. The mid-section 146 is preferably wider than the panel section 144 to act as a stop against the insulative panel 180. The mid-section 146 may also include a passageway 154 (FIG. 5) that is adapted to receive the locking member 160. Although the housing block 140 is shown as grouping together more than one socket contact assembly 130, the housing block 140 may be configured to support a single socket contact assembly 130.

An insulative outer housing 156 (FIGS. 7 and 8) may surround the housing block 140. The outer housing 156 preferably includes one or more access openings 158 that correspond to the open ends 150 of the socket supporting section 142, respectively, for receiving the mating pin contacts 112. The outer housing 156 may include one or more insulative plugs 190 tied thereto such that when the pin contacts 112 are not received in the socket contacts 132, the insulative plugs 190 can be inserted into the respective access openings 158, through the open ends 150, and into the socket contacts 132, so that the plugs 190 in combination with the insulative outer housing 156, cover all exposed conductive surfaces.

Figure 9:
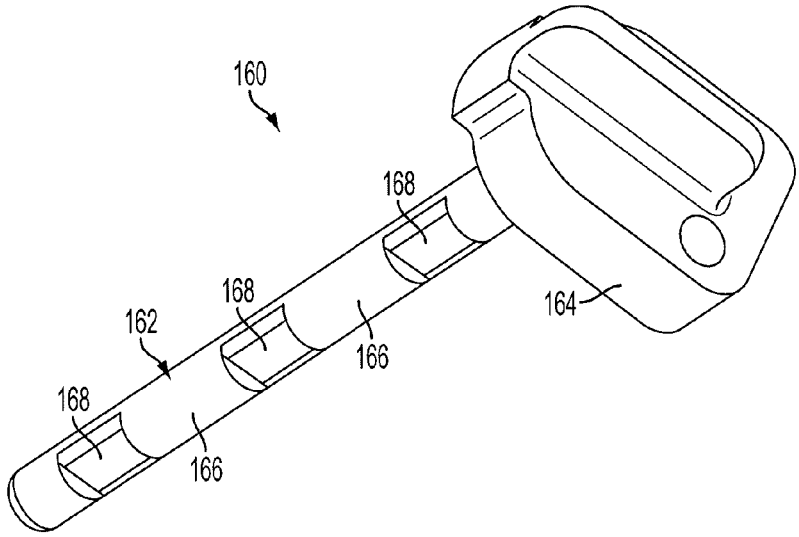
FIG. 9 is a perspective view of a locking member of the cable connector system illustrated in FIG. 1.
Figure 10:
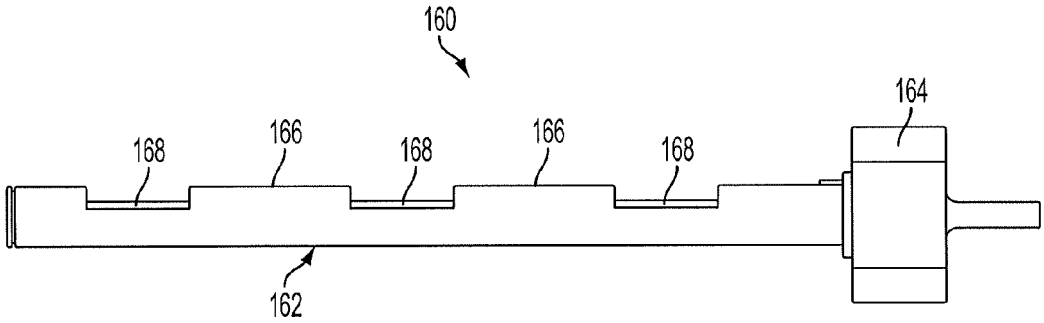
FIG. 10 is a side elevational view of the locking member illustrated in FIG. 9.

FIGS. 9 and 10 illustrate an exemplary locking member 160 in accordance with the present invention. The locking member 160 generally includes a stem 162 and a lever 164. The stem 162 preferably includes an outer locking surface 166 adapted to engage the locking surface 176 of the cap 116 when the pin and socket contact assemblies 110 and 130 are mated. The stem 162 may include one or more undercuts 168 for releasing the locking member 160 from a locked position upon rotation of the lever 164. Each undercut 168 is preferably arranged such that the longitudinal length of the lever 164 is substantially perpendicular to the longitudinal lengths of the undercuts 168 such that rotating the lever locks and releases the locking member 160. The stem 162 is configured to be received in the passageway 154 of the housing block 140.

Figure 11:
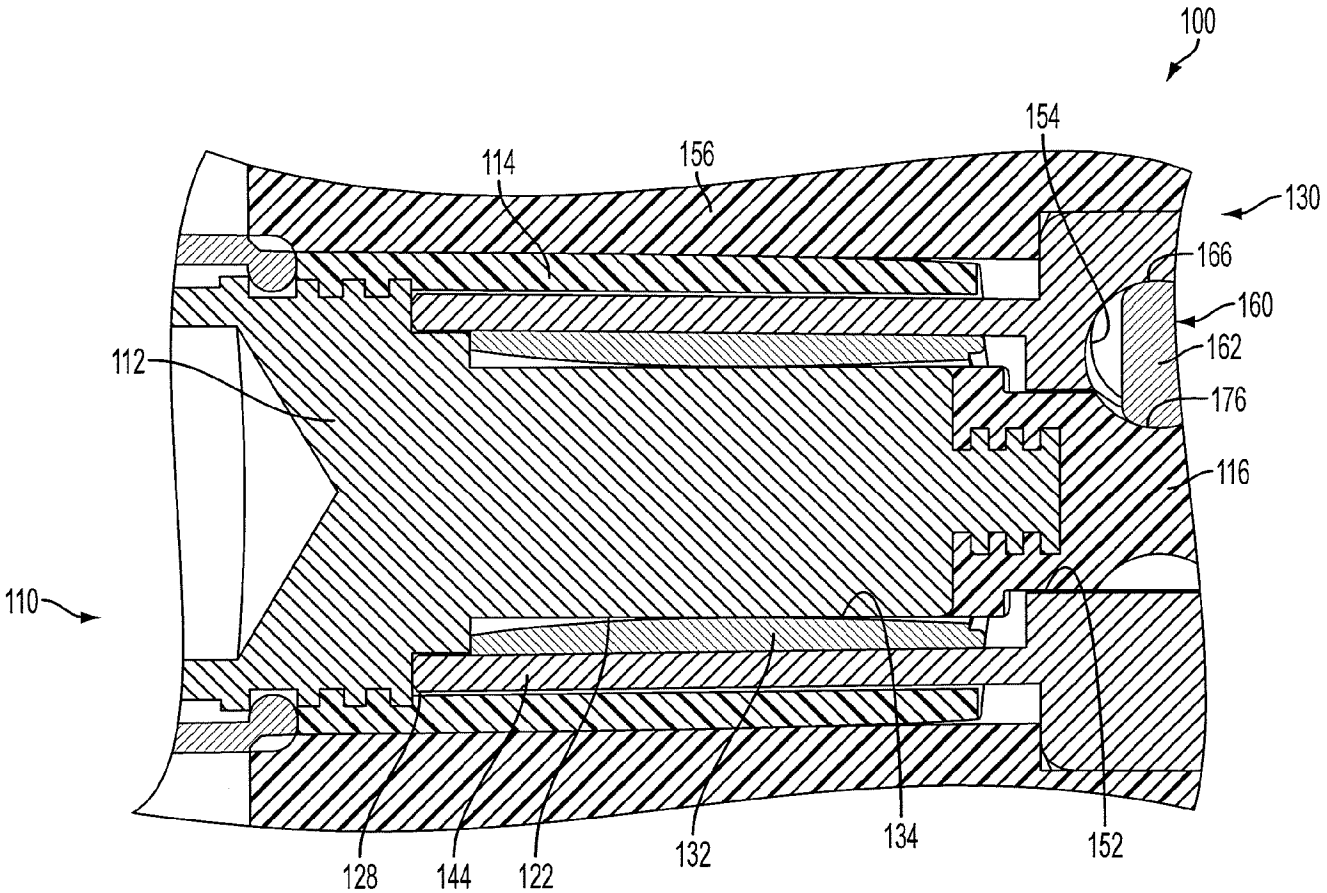
FIG. 11 is a partial cross-sectional view of one of the plurality of plug contact assemblies illustrated in FIG. 1 mated with one of the plurality of socket contact assemblies illustrated in FIG. 1.

As seen in FIG. 11, when the pin contact assembly 110 is mated with the socket contact assembly 130, the pin contact 112 is received in the socket contact 132 such that the contact surfaces 122 and 134 engage, thereby forming an electrical path between the assemblies. The socket supporting section 142 of the housing block 140 is accepted in the receiving area 128 of the pin contact assembly 110 and the outer housing 156 of the socket contact assembly 130 surrounds the main housing 114 of the pin contact assembly 110. The insulative cap 116 of the pin contact assembly 110 is inserted into the secondary bore 152 of the housing block 140.

When the pin and contact assemblies 110 and 130 are mated, they may be locked together by the locking member 160 such that the pin contact assembly 110 cannot be pulled axially out of the socket contact assembly 130. In particular, the outer locking surface 166 of the locking member 160 engages the locking surface 176 of the cap 116 in an interference fit, as seen in FIG. 11. That is the stem 162 of the locking member 160 is received in the annular groove 176 in an interference fit. The locking member 160, however, does not prevent the pin contact assembly 110 from rotating with respect to the socket contact assembly 130. To release the locking member 160, the lever 164 of the locking member 160 is rotated until the undercut 168 of the locking member 160 reaches the groove 176 of the cap 116, thereby disengaging the interference fit therebetween.

As seen in FIGS. 1 and 2, one locking member 160 may be used to lock multiple pin and socket contact assemblies 110 and 130. In that case, the number of undercuts 168 on the stem 162 of the locking member 160 should equal the number of pin or socket contact assemblies to provide a release mechanism for each. Also, it is preferable that several groups of pin and contact assemblies 110 and 130 be mounted to the insulative panel 180 for a higher density of cable connections, as seen in FIG. 1. However, the system of the present invention may include a single pin contact assembly 110 mated to a single socket contact assembly 130 that are mounted to the panel 180.

When mated, all conductive surfaces of the pin and socket contact assemblies 110 and 130 are preferably covered by an insulative member. More specifically, the pin contact 122 is covered not only by the main housing 114 and the cap 116 but also by the outer housing 156 of the socket contact assembly 130. And the socket contact 132 is covered by the main housing 114 of the pin contact assembly 110 and by the outer housing 156. When the pin and contact assemblies 110 and 130 are not mated, the cap 116 and the main housing 114 cover the surfaces of the pin contact 112 and the outer housing 156 of the socket contact assembly 130 and along with the insulative plug 190 cover all exposed surfaces of the socket contact 132.

While particular embodiments have been chosen to illustrate the invention, it will be understood by those skilled in the art that various changes and modifications can be made therein without departing from the scope of the invention as defined in the appended claims.

What is claimed is:

1. A cable connector system, comprising:

a first contact assembly including a housing and a first contact received in said housing, said first contact having a cable termination portion configured to terminate a cable at an end thereof and an interface portion including a first contact surface and a cap at an end thereof, said cap having a first locking surface;

a second contact assembly that mates with said first contact assembly, said second contact assembly including a housing and a second contact received in said housing, said second contact having a second contact surface configured to engage said first contact surface of said first contact assembly and said second contact being rotatable with respect to said first contact of said first contact assembly; and a locking member including a second locking surface configured to engage said first locking surface of said cap, wherein when said second locking surface engages said first locking surface, said first contact assembly is prevented from moving axially with respect to said second contact assembly while said first contact remains rotatable with respect to said second contact.

2. A cable connector system according to claim 1, wherein said first contact is a pin and said second contact is a socket; and said first contact surface of said pin maintains contact with said second contact surface of said socket when said pin rotates with respect to said socket.

3. A cable connector system according to claim 1, wherein said cap of said first contact assembly is threadably engaged to said end of said interface portion.

4. A cable connector system according to claim 1, wherein said first contact surface is an outer surface of said first contact and said second contact surface is an inner surface of said second contact.

5. A cable connector system according to claim 1, wherein a receiving area is defined between said interface portion of said first contact and said housing of said first contact assembly; and a portion of said housing of said second contact assembly is received in said receiving area.

6. A cable connector system according to claim 1, wherein said first locking surface of said cap is at least a portion of an outer surface of said cap; and said second locking surface is at least a portion of an outer surface of said locking member such that said first and second locking surfaces engage in an interference fit to prevent axial movement of the first contact assembly with respect to said second contact assembly.

7. A cable connector system according to claim 1, wherein said first locking surface of said cap is an annular groove.

8. A cable connector system according to claim 6, wherein said outer surface of said locking member includes an undercut that releases said interference fit between said cap of said first contact assembly and said locking member when said locking member is rotated with respect to said cap.

9. A cable connector system according to claim 8, wherein said locking member includes a lever and a stem extending from said lever, said stem including said second locking surface and said undercut.

10. A cable connector system according to claim 9, wherein a longitudinal length of said lever being substantially perpendicular to a longitudinal length of said undercut.

11. A cable connector system, comprising:

a first contact assembly including a housing, a first conductive contact received in said housing, and a receiving area defined between said housing and said first conductive contact, said housing being insulative and said first conductive contact having a cable termination portion configured to terminate a cable at an end thereof and an interface portion including a first contact surface and a cap at an end thereof, said cap being insulative;

a second contact assembly that mates with said first contact assembly, said second contact assembly including an outer housing and a second conductive contact received in said outer housing, said outer housing being insulative and said second conductive contact having a second contact surface configured to engage said first contact surface of said first contact assembly defining an electrical path therebetween; and an insulative plug configured to be received in said second contact assembly when said second contact assembly is not mated with said first contact assembly, wherein when said first and second contact assemblies are mated, said housing of said first contact assembly covers all exposed surfaces of said second conductive contact and said outer housing of said second contact assembly covers all exposed surfaces of said first conductive contact, and wherein when said first and second contact assemblies are unmated, said cap and said housing of said first contact assembly covers all exposed surfaces of said first conductive contact and said outer housing of said second contact assembly and said insulative plug cover all exposed surfaces of said second conductive contact.

12. A cable connector system according to claim 11, wherein said cap is threadably coupled to said end of said interface portion of said first conductive contact.

13. A cable connector system according to claim 11, wherein said second contact assembly includes a housing block that supports said second conductive contact, said housing block is conductive, and said outer housing surrounds said conductive block.

14. A cable connector system according to claim 11, wherein said first contact is a pin and said second contact is a socket.

15. A cable connector system, comprising:

a plurality of first contact assemblies, each of said first contact assemblies including a first contact having a cable termination portion configured to terminate a cable at an end thereof and an interface portion including a first contact surface and a cap at an end thereof, said cap having a first locking surface;

a plurality of second contact assemblies mateable with said first contact assemblies, each of said second contact assemblies including a second contact having a second contact surface configured to engage said first contact surfaces, respectively, each of said second contacts being rotatable with respect to each of said first contacts, and a housing block supporting said second contact assemblies; and a locking member including a second locking surface configured to engage said first locking surfaces of said first contact assemblies, wherein when said second locking surface engages each of said first locking surfaces, each of said first contact assemblies is prevented from moving axially with respect to each of said second contact assemblies while each of said first contacts remain rotatable with each of said second contacts.

16. A cable connector system according to claim 15, wherein said first locking surface of said cap of each of said first contacts is at least a portion of an outer surface of said cap; and said second locking surface is at least a portion of an outer surface of said locking member such that said second locking surface of said locking member engages each of said first locking surfaces in an interference fit.

17. A cable connector system according to claim 16, wherein said outer surface of said locking member includes a plurality of spaced undercuts that release said interference fit when said locking member is rotated with respect to said housing block.

18. A cable connector system according to claim 17, wherein said locking member includes a lever and a stem extending from said lever, said stem including said second locking surface and said plurality of undercuts.

19. A cable connector system according to claim 18, wherein a longitudinal length of said lever being substantially perpendicular to a longitudinal length of each of said undercuts.

20. A cable connector system according to claim 18, wherein said plurality of undercuts corresponds to the number of first contact assemblies.

21. A cable connector system according to claim 15, wherein said housing block has a passageway configured to receive said locking member.

22. A cable connector system according to claim 21, wherein said housing block is surrounded by an outer housing; and said housing block is conductive and said outer housing is insulative.

23. A cable connector system according to claim 15, wherein said plurality of first contact assemblies are pin contact assemblies; and said plurality of second contact assemblies are socket contact assemblies.

* * * * *